US007790136B2

(12) United States Patent
Lee et al.

(10) Patent No.: US 7,790,136 B2
(45) Date of Patent: Sep. 7, 2010

(54) METHOD FOR PREPARING POROUS FABRICS

(75) Inventors: Chien-Hung Lee, Kaohsiung (TW); Chung-Hua Hu, Taichung (TW)

(73) Assignee: Linkwin Technology Co., Ltd. (TW)

( * ) Notice: Subject to any disclaimer, the term of this patent is extended or adjusted under 35 U.S.C. 154(b) by 545 days.

(21) Appl. No.: 11/977,899

(22) Filed: Oct. 26, 2007

(65) Prior Publication Data

US 2009/0110628 A1 Apr. 30, 2009

(51) Int. Cl.
*D01F 9/12* (2006.01)

(52) U.S. Cl. ..... 423/447.6; 423/364

(58) Field of Classification Search ..... 423/447.6, 423/364

See application file for complete search history.

(56) References Cited

U.S. PATENT DOCUMENTS 4,921,686 A * 5/1990 Yoshida et al. ..... 423/447.6
6,156,287 A * 12/2000 Ko ..... 423/447.1

* cited by examiner

*Primary Examiner*—Edward M Johnson
(74) *Attorney, Agent, or Firm*—Moser IP Law Group

(57) ABSTRACT

A method for preparing porous fabrics is disclosed. The method includes transporting PAN-based oxidized fabrics to a thermal treatment chamber, which provides multi-pipe to introduce oxygenated gas and oxygenated fluid respectively, by using a plurality set of rollers to carry out an activation-carbonization process. The activation-carbonization process is preformed within a temperature range of 1010° C. to 1500° C., and produced the porous activated carbon fabrics that provide uniform nano-pore with BET surface area about 800~1500 m2/g.

11 Claims, 3 Drawing Sheets

METHOD FOR PREPARING POROUS FABRICS

BACKGROUND

1. Field of Invention

The present invention relates to a method for preparing porous fabrics and a device thereof. More particularly, the present invention relates to a method for preparing a porous activated carbon fabric with uniform nano-pore distribution.

2. Description of Related Art

Activated carbon is a porous material with good absorption, electrical conduction, and regeneration characteristics that is applied to the products of environmental protection, industrial purpose, and high tech industrial purpose. Activated carbon is used in gauze masks, protection cloths, and gas masks for chemical, medical, and military purposes; or general textile products, water purification, and liquid waste treatment.

Activated carbon is generally divided into granulate activated carbon, activated carbon powder and activated carbon fiber. Granulate activated carbon and activated carbon powders are conventional types made by carbonizing the coconut shell, brown coal, peat or other such material at high temperature. The manufacturing processes of both the above-mentioned activated carbons are low cost and the materials are easy to obtain, but the products exhibit poor absorption characteristics and have high impurity content.

Activated carbon fiber (fabric) includes cellulose-based, phenol resin-based, pitch-based, and polyacrylonitrile-based (PAN) activated carbon fiber wherein the cellulose-based, phenol resin-based, and pitch-based activated carbon fiber exhibit poor mechanical properties. The PAN-based activated carbon fiber has advantages over the other activated carbon fibers is reasonable cost and good mechanical properties that provide future development potential.

An activated carbon fabric is generally manufactured by employing a PAN-oxidized filament or yarn as a raw material to undergo an activation process and a carbonization process to form an activated carbon filament (or yarn), and the activated carbon filament (or yarn) further forms an unwoven fabric by conventional unweave method. The activation process is preformed by chemical activation or physical activation process. The chemical activation treats the PAN-based oxidized fiber by using chemicals such as $ZnCl_2$, $H_3PO_4$, KOH, or $K_2S$ at a low working temperature. The disadvantages of the chemical activation process are lower purity of activated carbon and environmental pollution from the steps used to wash the chemicals away. The physical activation process employs oxygenated gas to activate the PAN-based oxidized fiber, and the disadvantages include consumption of more energy to maintain a high working temperature and high tar content.

Recently, the PAN-based oxidized fabric of the fireproof cloth has been employed to form the porous activated carbon fabric. A water-containing carbon dioxide gas made by passing the carbon dioxide through water was an activating gas for activating the PAN-based oxidized fabric in a high temperature chamber to form a PAN-based activated carbon fabric. However, controlling the saturation steam of the carbon dioxide is difficult and causes different pore distributions in the activated carbon fabric. Therefore the quality of the product is unstable.

For the forgoing reasons, there is a need for developing a more convenient and effectively process to solve the problem of various pore distributions and the unstable quality of PAN-based activated carbon fabric.

SUMMARY

The present invention is directed to a method for preparing porous fabrics to solve the problem of various nano-pores distribution of the PAN-based activated carbon fabric made by conventional process.

In accordance with the foregoing respect of the present invention, a method for preparing porous fabrics includes employing a PAN-based oxidized fabric as a raw material and processing an activated-carbonization process. The activated-carbonization process employs a thermal treatment chamber with multi-pipe to introduce an activation gas and/or activation fluid into the thermal treatment chamber through the pipes, and transporting the PAN-based oxidized fabric to the thermal treatment chamber by rollers at a working temperature within 1010° C.~1500° C. The activated-carbonization process manufactures porous fabrics with large BET (Brunauer-Emmett-Teller) surface area of 800~1500 $m^2/g$ and uniform nano-pores distribution that is suitable for manufacturing the activated carbon fabric.

In accordance with the embodiments of the present invention, the activation gas is an oxygenated gas such as oxygen, carbon dioxide, carbon monoxide, water vapour, air, or a combination thereof. The activation fluid is an oxygenated fluid such as pure water, tap water, hydrogen peroxide solution, electrolyzed oxidizing water, or a combination thereof.

These and other features, aspects, and advantages of the present invention will become better understood with reference to the following description, appended claims and accompanying drawings. It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
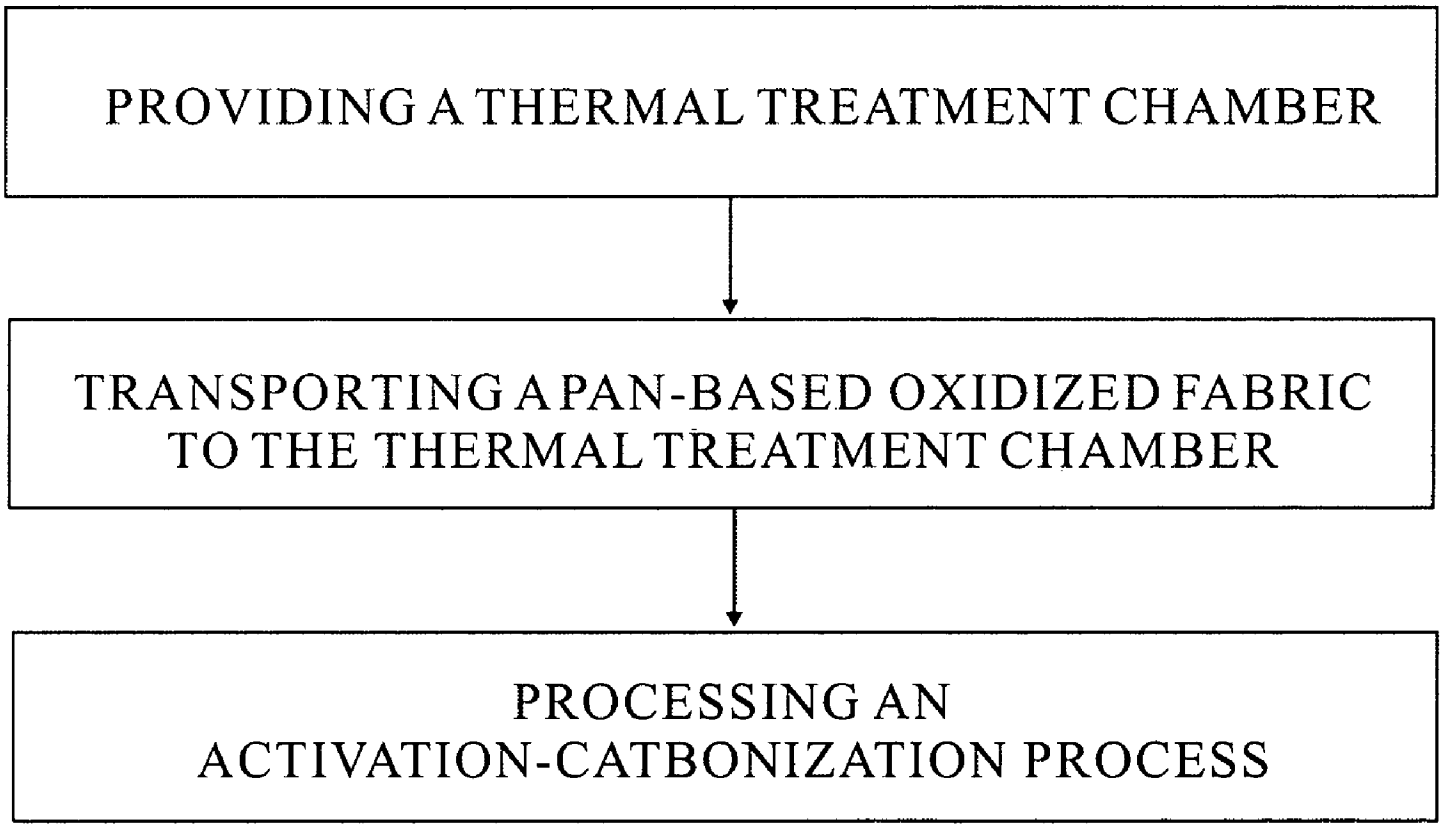
FIG. 1 is a flow chart of a porous fabric preparing process in accordance with an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Refer to FIG. 1. FIG. 1 is a flow chart of a porous fabric preparing process in accordance with an embodiment of the present invention.

The process of preparing a porous fabric includes transporting a PAN-based oxidized fabric to a thermal treatment chamber by rollers, where the thermal treatment chamber provides a plurality of reactant transporting pipes to introduce a plurality of reactants respectively; and processing an activation-carbonization process by reacting the PAN-based oxidized fabric with oxygenated reactant at a working temperature to produce a porous activated carbon fabric with uniform nano-pore distribution.

Figure 2:
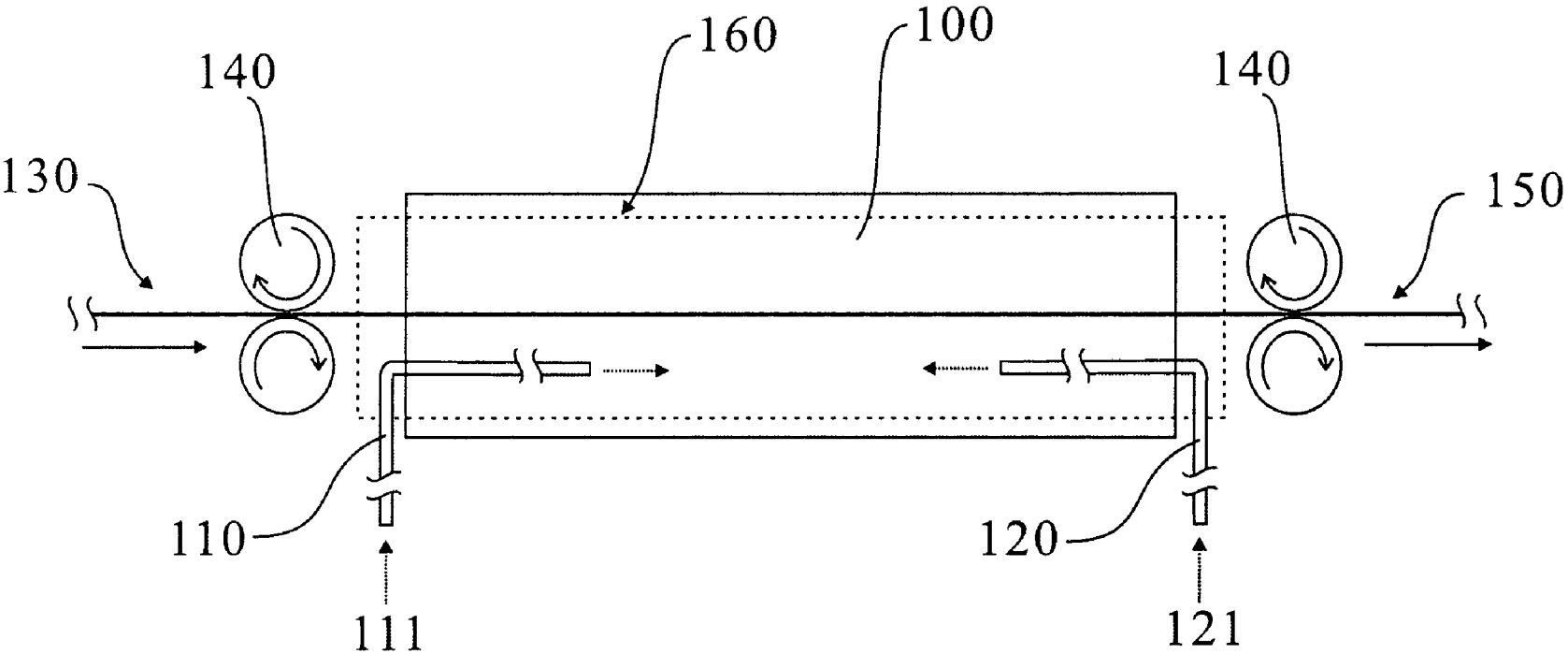
FIG. 2 is an operational and schematic view of a device for preparing porous fabrics in accordance with an embodiment of the present invention.

Refer to FIG. 2. FIG. 2 is an operational and schematic view of a device for preparing porous fabrics in accordance with an embodiment of the present invention.

The device includes a thermal treatment chamber 100, which comprises a plurality of reactant-transporting pipes 110, 120 distributed apart from each other for introducing respectively reactants (gas or fluid) into the thermal treatment chamber 100 through the respective reactant-transporting pipe of the reactant transporting pipes. The inlet and outlet of the thermal treatment chamber 100 are both protected with inert gas.

In accordance with one embodiment of the present invention, the reactant-transporting pipes of the thermal treatment chamber 100 introduces only oxygenated fluid reactant, such as pure water, tap water, hydrogen peroxide solution, electrolyzed oxidizing water, or a combination thereof.

In accordance with another embodiment of the present invention, the reactant-transporting pipes of the thermal treatment chamber 100 introduces only oxygenated gaseous reactants, such as oxygen, carbon dioxide, carbon monoxide, water vapour, air, or combination thereof.

In still another embodiment of the present invention, the reactant transporting pipes of the thermal treatment chamber 100 introduces oxygenated gaseous reactant and oxygenated fluid reactant simultaneously. For example, a reactant-transporting pipe 110 introduces a gaseous reactant such as oxygen, carbon dioxide, carbon monoxide, water vapour, air, or a combination thereof; and a reactant-transporting pipe 120 introduces fluid reactant, such as pure water, tap water, hydrogen peroxide solution, electrolyzed oxidizing water, or a combination thereof. It is to be understood that the amount, shape or disposition of the reactant transporting pipes shown at FIG. 1 are by examples, other amount, shape or disposition are possible.

In the embodiments of the present invention, the gaseous reactant does not need to be mixed within the fluid reactant in advance thereby simplifying the activation-carbonization process as compared with the conventional process. The gaseous reactant 111 and the fluid reactant 121 are introduced into the thermal treatment chamber 100 independently and respectively through the respective reactant transporting pipes 110,120. Thus, the cost for gas-fluid mixing device is reduced.

The material of the porous fabric is a PAN-based oxidized fabric. In accordance with an embodiment of the present invention, the PAN-based oxidized fabric 130 is transported to the thermal treatment chamber 100 by using one or more sets of rollers 140 along the direction of the arrowhead illustrated in FIG. 2 to carry out an activation-carbonization process.

The thermal treatment chamber 100 is kept at a working temperature to process the activation-carbonization process. The heating portion of the chamber is pointed out as the dotted line 160 in FIG. 2. In accordance with an embodiment of the present invention, the working temperature is within a range of 1010° C. to 1500° C., and the processing time of the activation-carbonization is about 1 to 60 minutes. Because the gaseous reactant 111 and the fluid reactant 121 are introduced into the thermal treatment chamber 100 independently through the reactant transporting pipe 110 and the reactant transporting pipe 120 respectively, so the concentration and the flow rate of the reactant gas and the reactant fluid can be controlled precisely. In contrast with the conventional process, the present process produces a porous activated carbon fabric 150 with uniform nano-pore distribution. The operation of the present process ensures that uniform nano-pores distribution in the full length of the PAN-based oxidized fabric material in continuously transportation process by rollers, and the resulted BET surface area of the porous activated carbon fabric 150 is about 800~1500 $m^2/g$.

Table 1 summarized the results of the nano-pores uniformity in various sections of the whole roll of porous activated carbon fabric produced by the present process. Four rolls of PAN-based oxidized fabric materials were transported into the thermal treatment chamber with a constant speed to perform respective activation-carbonization processes. The activation-carbonization processes employ water as a reactant and the working temperature was set at 1010, 1050, 1150, and 1200° C., respectively. After five minutes, sampling a segment of each produced activated carbon fabric with 30-50 centimeters from the point extended 100 meters, 1000 meters and 5000 meters from the initial point of the activated carbon fabric, and further dividing the segment into multiple pieces wherein each of the piece is 5-10 centimeters. To observe the BET surface area variation of different portions of the whole roll of porous activated carbon fabric, the BET surface area of the pieces were measured in according to ASTM D3633-03 standard test with multi-points relative pressure testing (P/P0=0.06, 0.08, 0.1, 0.14, 0.16 and 0.2) by using a micro pore size and surface area analyzer (Micromeritics ASAP 2020).

TABLE 1

| WORKING TEMPERATURE (° C.) | BET SURFACE AREA (100 m) ($m^2/g$) | BET SURFACE AREA (1000 m) ($m^2/g$) | BET SURFACE AREA (5000 m) ($m^2/g$) | STANDARD DEVIATION (STD) | UNIFORMITY (%) |
|---|---|---|---|---|---|
| 1010 | 931 | 973 | 955 | 21.1 | 2.2% |
| 1050 | 1005 | 1028 | 1049 | 22.0 | 2.1% |
| 1100 | 1072 | 1098 | 1118 | 23.1 | 2.1% |
| 1150 | 1035 | 1061 | 1085 | 25.0 | 2.4% |
| 1200 | 920 | 945 | 965 | 22.5 | 2.4% |

Figure 3:
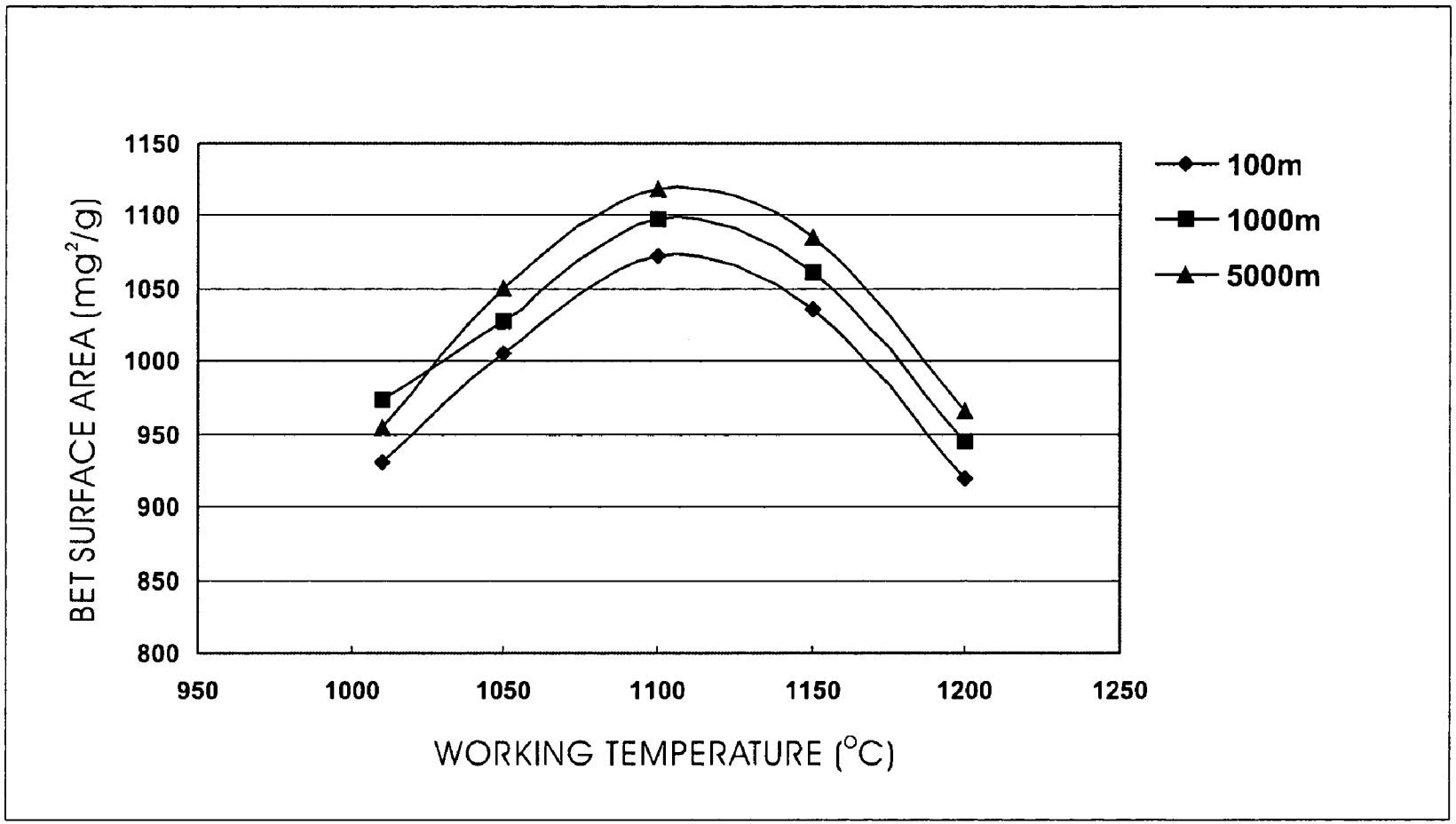
FIG. 3 is a diagram drawn in according to the results of Table 1.

Refer to the Table 1 and FIG. 3. FIG. 3 is a diagram drawn in according to the results of Table 1. FIG. 3 shows that applying the present process can increase BET surface areas within a range of 900-1200 $m^2/g$ and provide good consistency of BET surface areas in different portions of the whole roll of porous activated carbon fabric. There is no difference between the nano-pore distribution of activated carbon fabric portion produced at the beginning of the processing time and the portion produced afterward. That is, the process in accordance with the embodiment of the present invention not only applying to continuous manufacture of the porous fabric but also improves uniform nano-pore distribution of the porous fabric.

There are advantages of applying the process of the embodiment of the present invention are represented as follow:

The embodiment of the present invention introduces the reactants to a thermal treatment chamber through the respective reactant transporting pipes at a high working temperature to carbonize and activate the PAN-based oxidized fabric simultaneously will enable to reduce the processing time and enhance output. Moreover, the process employs the oxygenated gas and/or oxygenated fluid as the activator not only easier for obtaining the reactants but also do not pollute the environment.

Moreover, the embodiment of the present invention provides a more convenient process and a device to introduce gaseous and fluid reactants to the thermal treatment chamber simultaneously without mix the gaseous reactant with the fluid reactant in advance that simplify the process of PAN-based activated carbon fabric and relatively reduce the cost for gas-fluid mixing process and the mixer thereof. The plurality of independent reactant transporting pipes are distributed in different areas of the thermal treatment chamber can precisely control the flow rate and concentration of each reactant; and the controlled reactants are sufficient for activate the PAN-based oxidized fabric to form uniform nano-pore distributions. It is therefore, the present activation-carbonization process is a continuous manufacturing process with good quality control where provides consistent pores distribution in whole roll porous activated carbon fabric.

Although the present invention has been described in considerable detail with reference to certain preferred embodiments thereof, other embodiments are possible. Therefore, the spirit and scope of the appended claims should not be limited to the description of the preferred embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of preparing porous fabrics, comprising:

providing a thermal treatment chamber which comprises a plurality of reactant transporting pipes;

transporting a PAN-based oxidized fabric to the thermal treatment chamber; and processing an activation-carbonization process by introducing respectively a plurality of reactants through the reactant transporting pipes into the thermal treatment chamber at a working temperature within a range of 1010° C. to 1500° C. to produce a porous activated carbon fabric with uniform nano-pore distribution, where each of the reactants is one of an oxygenated gas and an oxygenated fluid.

2. The method of claim 1, wherein a BET surface area of the porous activated carbon fabric is about 800~1500 $m^2/g$.

3. The method of claim 1, wherein the PAN-based oxidized fabric is transported to the thermal treatment chamber by using rollers.

4. The method of claim 1, wherein the oxygenated gas is oxygen, carbon dioxide, carbon monoxide, water vapour, air, or a combination thereof.

5. The method of claim 1, wherein the oxygenated fluid is pure water, tap water, hydrogen peroxide solution, electrolyzed oxidizing water, or a combination thereof.

6. The method of claim 1, wherein a processing time of the activation-carbonization process is within a range of 1 to 60 minutes.

7. A method of preparing porous fabrics, comprising:

providing a thermal treatment chamber which comprises a plurality of reactant transporting pipes;

transporting a PAN-based oxidized fabric to the thermal treatment chamber; and processing an activation-carbonization process by introducing an oxygenated fluid to the thermal treatment chamber through at least one of the reactant transporting pipes at a working temperature within a range of 1010° C. to 1500° C. to produce a porous activated carbon fabric with uniform nano-pore distribution.

8. The method of claim 7, wherein the BET surface area of the porous activated carbon fabric is about 800~1500 $m^2/g$.

9. The method of claim 7, wherein the PAN-based oxidized fabric is transported to the thermal treatment chamber by using one or more set of rollers.

10. The method of claim 7, wherein the oxygenated fluid is pure water, tap water, hydrogen peroxide solution, electrolyzed oxidizing water, or a combination thereof.

11. The method of claim 1, wherein a processing time of the activation-carbonization process is within a range of 1~60 minutes.

* * * * *